United States Patent [19]

Salinier et al.

[11] Patent Number: 4,725,715

[45] Date of Patent: Feb. 16, 1988

[54] APPARATUS FOR PRODUCING A JET OF GAS AT HIGH TEMPERATURE

[75] Inventors: Guy Salinier, Paris; Philippe Renault, Versailles; Pierre Lelong, Champigny-sur-Marne; Christophe Dembinski, Orleans, all of France

[73] Assignee: L'Air Liquide, Societe Anonyme Pour L'Etude Et . . ., Paris, France

[21] Appl. No.: 856,666

[22] Filed: Apr. 25, 1986

[30] Foreign Application Priority Data

Apr. 25, 1985 [FR] France ..... 85 06306

[51] Int. Cl.[4] ..... H02B 3/42

[52] U.S. Cl. ..... 219/367; 219/374; 219/381

[58] Field of Search ..... 219/374, 375, 376, 379, 219/380, 381, 382, 307, 367, 368; 239/136, 133

[56] References Cited

U.S. PATENT DOCUMENTS

| | | | |
|---|---|---|---|
| 1,388,526 | 8/1921 | Pieper | 219/367 X |
| 1,694,351 | 2/1928 | Long | 219/368 X |
| 1,987,936 | 1/1935 | Hildebrand | 219/374 X |
| 2,042,264 | 2/1935 | Levenhagen | 219/375 X |
| 2,819,378 | 1/1958 | Nokes et al. | 219/368 X |
| 3,007,032 | 10/1961 | Whiteman | 219/136 |
| 3,109,912 | 11/1963 | Cerulli | 219/381 |
| 3,371,188 | 2/1968 | Henes et al. | 219/375 X |
| 4,563,571 | 1/1986 | Koga et al. | 219/368 X |

FOREIGN PATENT DOCUMENTS

| | | | |
|---|---|---|---|
| 653325 | 12/1962 | Canada | 219/375 |
| 21997 | 9/1914 | United Kingdom | 219/368 |

OTHER PUBLICATIONS

Wetz, "Gas Heating System", IBM Technical Disclosure, Sep. 1978, pp. 1627–1628.

*Primary Examiner*—Patrick R. Salce
*Assistant Examiner*—Kristine Peckman
*Attorney, Agent, or Firm*—Lee C. Robinson, Jr.

[57] ABSTRACT

A tubular case closed at its two ends respectively by a first side wall carrying two electric supply terminals and a second side wall carrying a hot gas outlet nozzle for discharging a jet of heated oxygen. A heating tube extends axially through the case constituting a heating resistance, the wall or this heating tube being provided in one of its end portions with at least one opening for the passage of the gas to the interior of the heating tube and the outlet nozzle. The case also includes a heat exchanger of thermoconductive material and gas preheating means.

29 Claims, 7 Drawing Figures

APPARATUS FOR PRODUCING A JET OF GAS AT HIGH TEMPERATURE

The present invention relates to an apparatus for producing a jet of gas at high temperature, comprising a case, means for introducing a gas into the case, means for heating the gas in the case and means for discharging the hot gas from the case.

In various industrial fields jets of hot oxidizing gas, in particular oxygen, are used. For example, the oxygen cutting technique employs a torch from which issues an oxygen jet at high velocity surrounded by a heating flame.

The chemical phenomenon involved in oxygen cutting is not very well known. It appears that probably an oxidation of the iron in the form of oxides ($FeO$, $Fe_2O_3$, $Fe_3O_4$) occurs, which oxides have a melting temperature lower than that of the metal. There is observed the presence of a liquid and brilliant sheath between the jet of oxygen and the front of the kerf, this liquid sheath being driven by the jet of oxygen and discharged to the exterior in the form of droplets and sparks. The oxygen must diffuse in this liquid zone so as to maintain the combustion reaction of the iron. As this reaction is highly exothermic, the heat given off subsequently serves to maintain the high temperature required for the melting of the oxides.

At the present time, the peripheral heating flame is indispensable for initiating the reaction. After the initiation, the essential function of this heating flame is to maintain the upper edge of the kerf front at a temperature which is sufficient to ensure that the sheath of liquid slag can be renewed. However, as the heat required is provided by the reaction of the oxidation of the iron, the heat of the peripheral flame intervenes in fact only to avoid the risk of stopping of the reaction.

Thus it appears to be of interest to avoid the permanent presence of this heating flame, and/or to increase the cutting rate, this constituting one of the objects of the present invention.

Further, in other industrial fields, it is also desirable to have a hot gas generator, which gas may be an oxidizing gas, in applications such as metallurgy oxycombustible burners etc., or a non-oxidizing or inert gas, such as nitrogen in applications, for example, of the heat treatment type.

It is known from the German Pat. No. 726668 to cool the mixing nozzle of a torch by means of the cutting oxygen which is brought around the nozzle in a coiled tube surrounding the nozzle, the oxygen being thus pre-heated by recovery of a part of the heat given off by the oxygen cutting reaction.

Although it is envisaged in this patent to recover a part of the heat given off by the cutting, the essential object thereof is to cool the cutting nozzle and avoid an additional water cooling circuit.

An object of the present invention is therefore to provide an apparatus of simple design which has a good thermal efficiency and permits the production at its outlet of a jet of gas at a very high temperature which may reach 1600° C.

The invention provides an apparatus in which the gas heating means in the case are formed by a heating tube extending through the case and constituting a heating resistance, this tube having electric connecting means for the connection of this resistance to electric supply means, and heat exchange means disposed around the heating tube and in thermal contact with the latter, said heat exchange means comprising at least one pipe for conducting gas from the means introducing the gas into the case to an opening located in the vicinity of the first end of the heating tube whose second end communicates with the means for discharging hot gas from the case, the gas being thus heated in the heat exchange means before passing inside the heating tube and finally flowing through the means for discharging the hot gas from the case.

There will now be described, as non-limiting examples, various embodiments of the present invention with reference to the accompanying drawing, in which.

Figure 1:
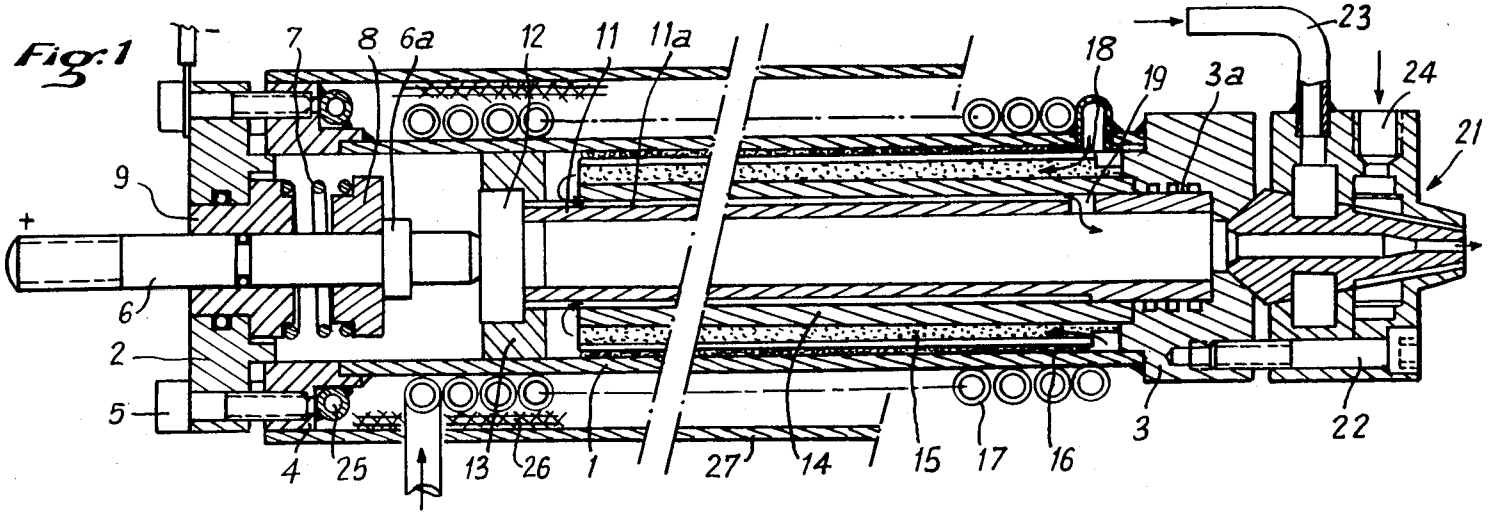
FIG. 1 is an axial sectional view of an apparatus for producing a jet of gas at high temperature of utility in particular for an oxygen cutting operation.

The apparatus shown in FIG. 1 comprises a tubular case 1, for example of stainless steel or a refractory material, having two opposite ends which are respectively closed by transverse side walls 2 and 3. The right closing side wall 3 is welded to the right end of the tubular case 1 while the left side wall 2 is removably mounted on a flange 4 welded to the left end of the case 1 and is fixed to this flange 4 by bolts 5. This closing wall 2 constitutes a support for two electric supply terminals, one of which is part of an electric contact 6 engaged inside the case 1, mounted to be axially slidable in the side wall 2 and biased toward the interior of the case by a spring 7 compressed between washer 8 and insulating sleeve 9 of, for example, alumina. The washer 8 is maintained in bearing relation to a flange 6*a* of the contact 6 while an insulating sleeve 9 is engaged in the central part of the closing side wall 2. The contact 6 projects axially out of the closing wall 2 and its outer end constitutes a terminal which may be connected to a positive pole of a DC power supply the negative pole of which may be connected to the closing wall 2, for example by means of a terminal lug held in position by one of the bolts 5. However, the apparatus may operate also with an AC power supply.

Disposed inside the case 1 is a heating element 11 constituted by a tube of a ceramic material, such as zirconia or lanthanum chromite or both of them associated for example. Such a ceramic compound has the feature of being both refractory (melting at around 2500° C.) and electrically conductive as soon as ambient temperature is reached. This ceramic tube is preferably formed by a resistant central portion and end portions which are conductive and have a resistivity which is about one tenth of that of the central portion. The end portions having a low resistivity may include, on the ceramic tube having a constant resistivity, platinum-plated outer zones. However, in a modification, the tube 11 could be entirely electrically resistant.

The ceramic heating tube 11 is fitted, at its right end, into a cavity 3*a* of the same diameter provided in the inner side of the right closing side wall 3 and it is applied against the end of this cavity 3*a* under the effect of the pressure exerted by the contact 6 on its opposite end under the action of the spring 7. In fact, this contact 6 is applied against the front side of a conductive end member 12, in the form of a washer, which bears against the left end of the ceramic heating tube 11. The extreme left portion of the heating tube 11 and the conductive washer 12 are disposed in an inner cavity of a ring 13 of alumina engaged in the case 1 and having an outside diameter which corresponds to the inside diameter of this case.

The ceramic heating tube 11 may or may not have a machined outer surface. This surface may have for example a screwthread or longitudinal splines.

The ceramic heating tube 11 is surrounded on the major part of its length by a heat exchanger of thermoconductive material. This heat exchanger may be formed by at least one inner tube 14 of dense thermoconductive material (for example alumina or lanthanum chromite) which is itself surrounded by an outer tube 15 of porous thermoconductive material (for example porous alumina). Optionally, there may be provided a winding of zirconia felt 16 between the outer tube 15 of porous alumina and the tubular case 1.

The gas which must be heated, such as oxygen or air, for example, flows through an outer coiled tube 17 which is wound around the tubular case 1 and in thermal contact with the latter. The gas is introduced into the coiled tube 17 at its left end, i.e. the end at which the contact 6 is located, and it enters the interior of the case 1, at the right end of the coiled tube which communicates with the interior of the case 1 through an opening 18 provided in this region in the wall of this case. The gas which enters the case 1 at its right end then flows in the space between the pipes 14 and 14 as indicated by the arrows, then longitudinally from the right to the left, through the outer porous alumina tube 15 which may optionally have longitudinal grooves for facilitating this flow, and, optionally through the winding of zirconia felt 16 if the latter is provided. At the left end of the tube 15 of porous alumina, the gas issues into a space defined between this left end and the ring 13 of alumina, then reverses its direction of flow in passing from the left to the right between the dense alumina tube 14 and the ceramic heating tube 11. This flow may be facilitated by the provision of longitudinal grooves or a screwthread on the outer surface of the heating tube 11 or on the inner surface of the dense alumina tube 14. In its right part, the heating tube 11 has in its wall at least one opening 19 which allows the gas to enter the interior of the tube 11. The hot gas can then issue from the apparatus by flowing in the form of an axial jet through an outlet nozzle 21 which is detachably fixed by screws 22 to the right closing side wall 3. This nozzle 21 may be a well-known oxygen cutting nozzle which may or may not be cooled. In the non-limiting example illustrated in FIG. 1, this nozzle is cooled by water supplied through a pipe 23. It also has a inlet orifice 24 for connection to a source of heating gas.

When the apparatus is in operation, the ceramic tube 11 is heated by the electric current travelling from the contact 6 through the conductive washer 12, then throughout the length of the heating tube 11 to the left closing side wall 2 which is connected to the negative pole of the electric supply source, i.e. to ground. Because of the passage of this electric current, the ceramic tube 11 is heated in its central portion of high resistivity so that the temperature of this central portion may reach about 1800° C. in normal operation. The end portions of the heating tube 11 reach a temperature of lower than 400° C. due to their much lower resistivity, which ensures the maintenance of a good electric contact. The heating tube 11 may be supplied with alternating or direct current, this heating tube behaving as a pure resistance. The measurement of the magnitude of the current and of the voltage permits the regulation of the Joule power supplied to the heating tube 11 and consequently the calorific power which may be absorbed by the gas. The dense alumina tube 14 and the porous alumina tube 15 are heated jointly with the inner heating tube 11 and in turn heat the case 1 and the coiled tube 17. The gas flowing in the coiled tube 17 is progressively heated in the latter and enters the container 1 at the outlet of the coiled tube 17, then continues to be heated when it flows first from the right to the left through the outer porous alumina tube 15 and, optionally, the winding of zirconia felt 16, then from the left to the right between the dense alumina tube 14 and the heating tube 11. Consequently, the gas jet issuing from the nozzle 21 may reach a temperature of around 1600° C.

Although there are preferably employed between the central heating tube 11 and the outer case 1, coaxial tubes 14 and 15 of alumina, it is also possible to employ tubes made from another material, for example lanthanum chromite. The dense alumina tube 14 is advantageously used since it exhibits good thermal characteristics, a coefficient of expansion approximately that of lanthanum chromite of the heating tube 11, and it also withstands very high temperatures. The porous alumina tube 15, preferably employed around the dense alumina tube 14, offers the advantage of being a better thermal insulator than dense alumina.

The winding of zirconia felt which may be provided between the porous alumina tube 15 and the case 1 permits reinforcing the insulation and also providing a large exchange surface for the gas which is also preheated in passing thereover.

As described above, the electric contact 6 is resiliently biased by the spring 7 against the heating tube 11 through the conductive washer 12. This permits the axial expansion and contraction of the heating tube 11 while maintaining a good electric contact. This expansion or contraction, which is transmitted to the outer part of the contact 6, may possibly be employed for regulating the temperature of the heating tube 11.

The left end part of the case 1 where the electric contact 6 is located, is advantageously cooled by a circulation of water in an inner tube 25 for example fixed to the inner side of the flange 4. To complete the description of the entire apparatus, the coiled tube 17 through which a still relatively cool gas travels, is advantageously covered with a layer 26 of a thermal insulating material, the latter being surrounded by an outer cylinder 27.

Figure 2:
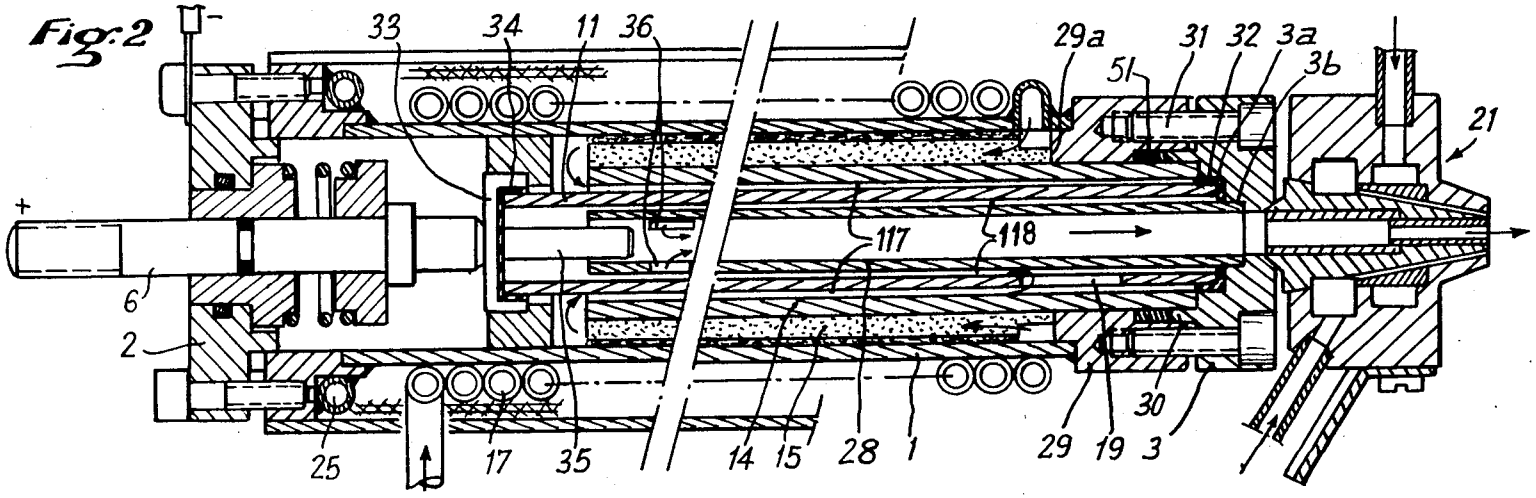
FIGS. 2, 3, 4, 5 and 6 are axial sectional views of modifications of the apparatus.

In the modification of the apparatus illustrated in FIG. 2, a tube 28 of dense alumina is placed coaxially inside the heating tube 11 and this tube 28 is engaged, by its right end, in a cavity of the same diameter provided in the inner side of the right closing side wall 3. This side wall is in this embodiment removably mounted on a cylindrical support 29 welded to the right end of the case 1, the removable wall 3 being removably fixed to the support 29 by screws 31. Provided in the inner side of the removable side wall 3 are, the cavity **3*a* of relatively large diameter, receiving the right end of the heating tube 11 and another cavity 3*b* of smaller diameter than the preceding cavity but deeper, and receiving the right end of the inner tube 28 of dense alumina. The platinum cup 32 is interposed between the extreme right portion of the heating tube 11 and its cavity 3*a* in the closing wall 3**.

Further, in the embodiment illustrated in FIG. 2, the inner tube 14 of dense alumina has a length greater than that of the outer tube 15 of porous alumina. In fact, the porous alumina tube 15 extends up to the left side 29a of the support 29, while the dense alumina tube 14 penetrates this support 29 and extends completely therethrough so as to come into contact, at its right end, with the internal face of the detachable closing wall 3. A washer 51 made of asbestos is placed between the right end of the dense alumina tube 14 and the cylindrical inner wall of the support 29, this washer being axially gripped by an inner coaxial flange 30 of the right closing wall 3.

The dense alumina inner tube 28 stops, inside tbe heating tube 11, at a certain distance from the left end of the latter. Further, the electric contact 6 bears against a conductive end member 33 containing a platinum cup 34 which caps the left end of the heating tube 11 which is platinum-plated. The conductive end member 33 is extended toward the right by an axial finger portion 35 partly extending into the inner tube 28 of dense alumina.

In its left end portion, the dense alumina inner tube 28 has at least one longitudinal slot 36 allowing the passage of the gas to the interior of the tube 28.

With this arrangement, the gas which enters the interior of the heating tube 11 through the openings or slots 19 provided in its right end portion, flows again inside the tube 11 toward the left in the space defined between this heating tube and the inner dense alumina tube 28, then it passes through the slot or slots 36 provided in the left end portion of the tube 28 and again flows inside the tube 28 from the left to the right in the direction toward the outlet nozzle 21.

Figure 3:
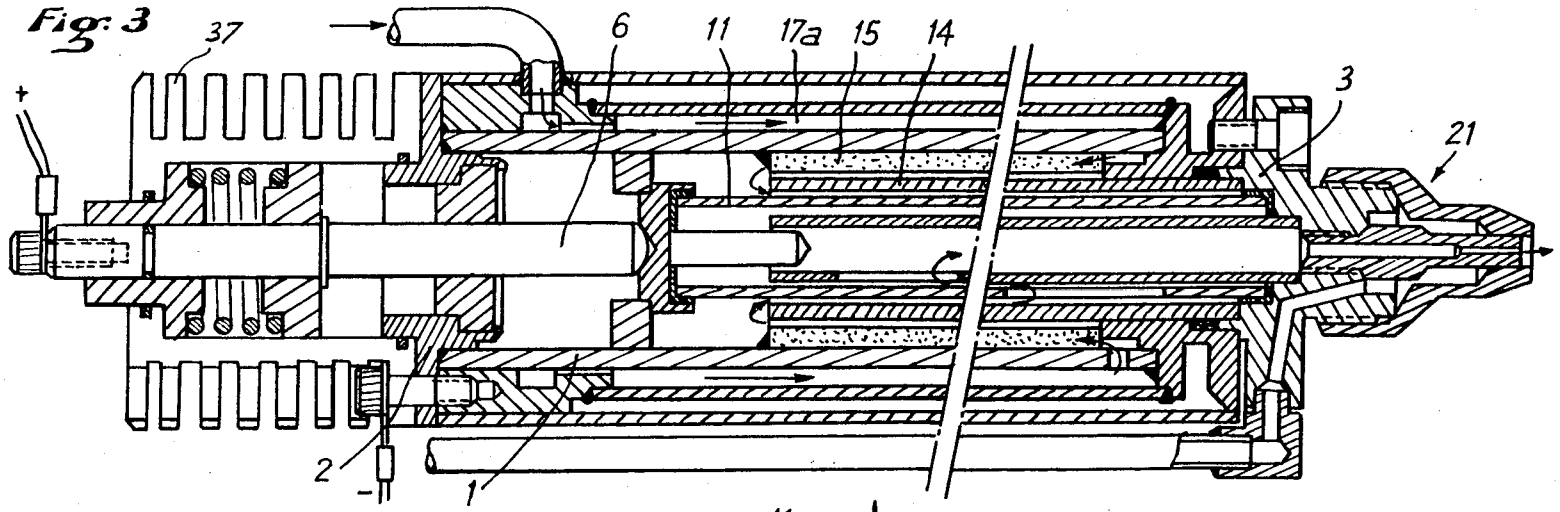

FIG. 3 illustrates a modification of the apparatus which is similar to that of FIG. 2 but in which the oxygen cutting nozzle 21 and the electric contact 6 are not cooled by a circulation of water. In this case, the contact 6 extends inside a finned radiator 37 mounted on the left closing wall 2 and thus ensures the natural cooling of the contact 6. Further, in this embodiment, the apparatus no longer has a coiled tube which is replaced by a cylindrical chamber 17a surrounding the heat exchanger 14,15.

Figure 4:
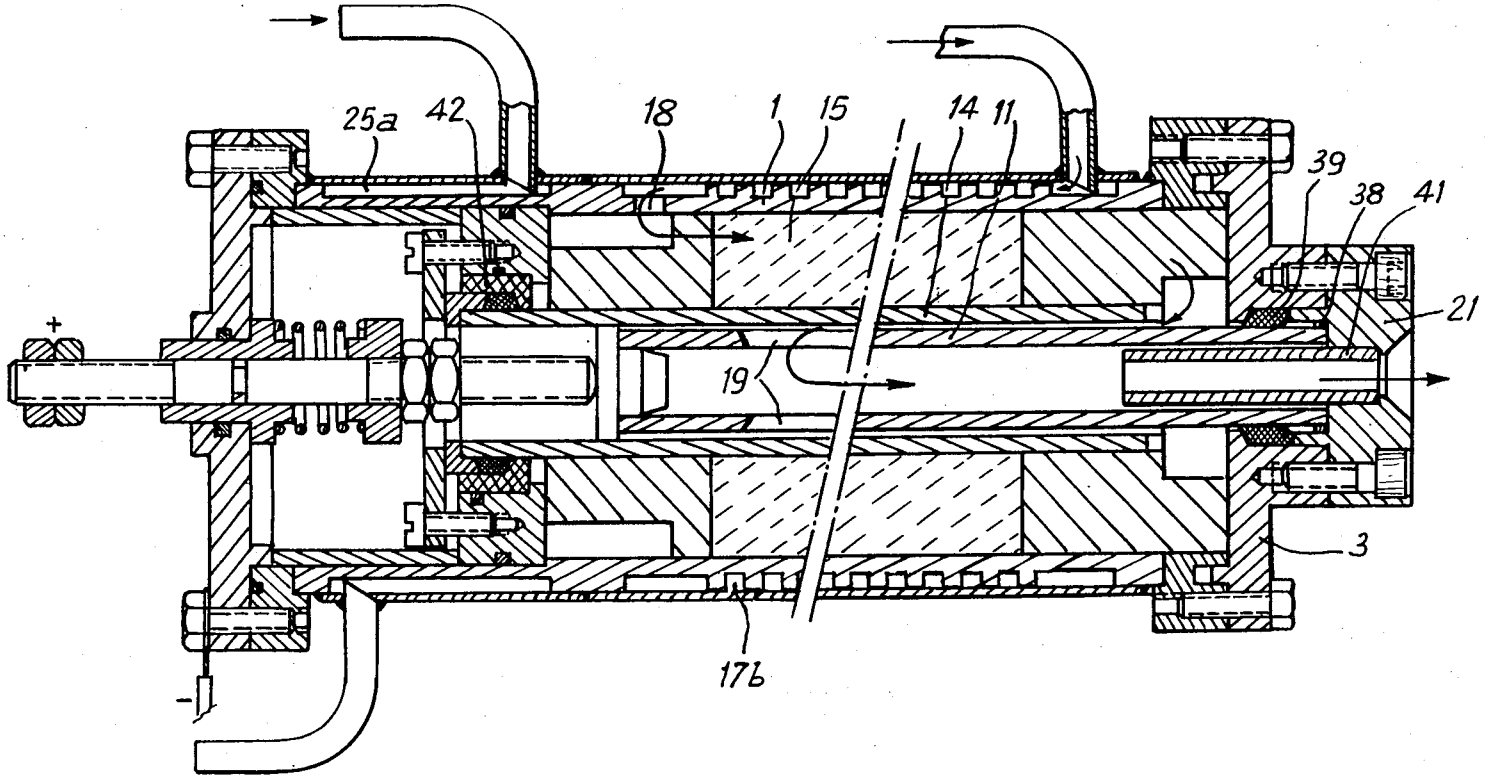

In the modification illustrated in FIG. 4, the heating tube 11 is held stationary, in its right end portion, i.e. that which is close to the outlet nozzle 21, by means of a clamp 38 of stainless steel with interposition of an asbestos ring 39 between the right end portion of the heating tube 11 and the right closing wall 3. Further, in this embodiment, the gas is introduced into a screwthread 17b at its right end, i.e. adjacent to the outlet nozzle 21, this screwthread 17b being machined in the outer surface of the tubular case 1. The gas enters the interior of the case 1 through openings 18 located in the left part of the case 1. Consequently, the gas enters the interior of the case 1, flows from the left to the right through the outer porous alumina tube 15, then from the right to the left between the inner dense alumina tube 14 and the heating tube 11, enters the interior of this heating tube by passing through the slots 19 provided in the left end portion of the heating tube 11 and flows axially to the right in the direction toward the outlet nozzle 21. A short alumina tube 41 is fixed on this nozzle and extends inside the right end portion of the heating tube 11.

In the embodiment illustrated in FIG. 4, the dense alumina tube 14 is held stationary by a packing box 42 in the vicinity of the electric contact 6. Further, the cooling of the left part of the apparatus is achieved by a circulation of water in an outer cylindrical chamber 25a.

Figure 5:
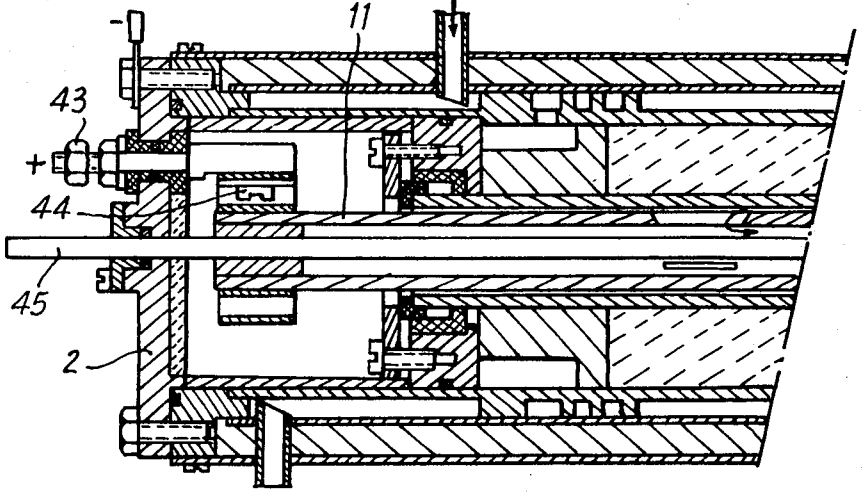

In the modification illustrated in FIG. 5, the left end portion of the heating tube 11 is directly connected to an electric supply terminal 43 carried by the left closing wall 2, through a braided conductor 44. Further, a thermocouple 45 for the regulation may also be axially inserted inside the heating tube 11 through the left closing wall 2. There may also be longitudinally introduced in the heating tube 11 another tube for the heating or pre-heating of a fluid through this tube which is of refractory material.

Figure 6A:
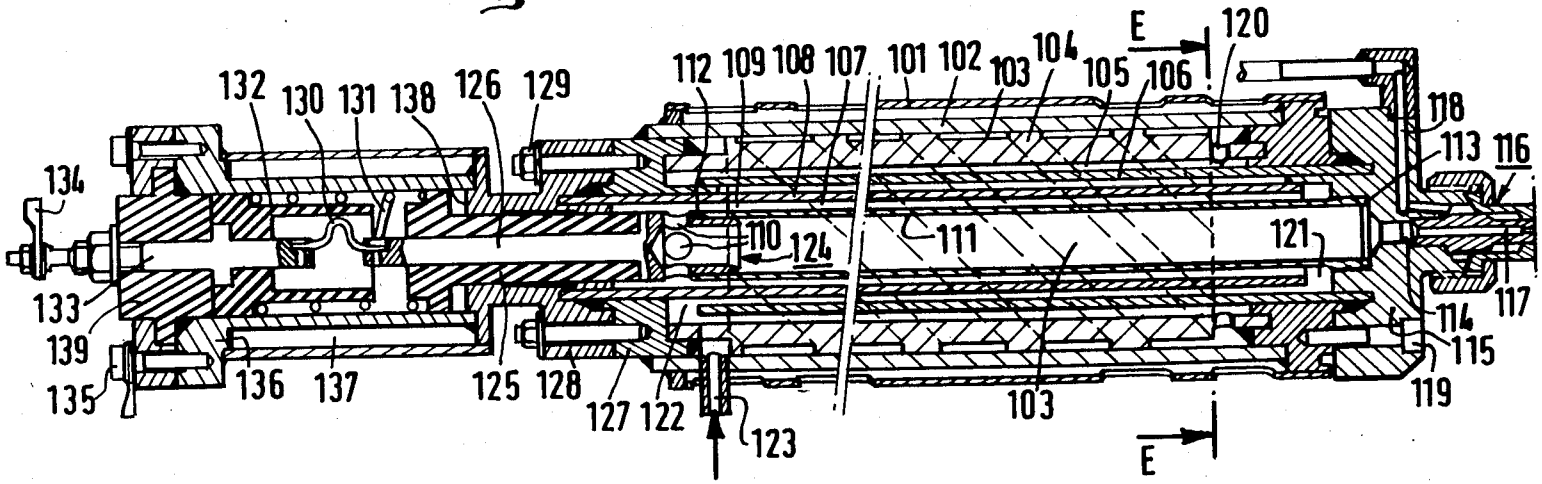
Figure 6B:
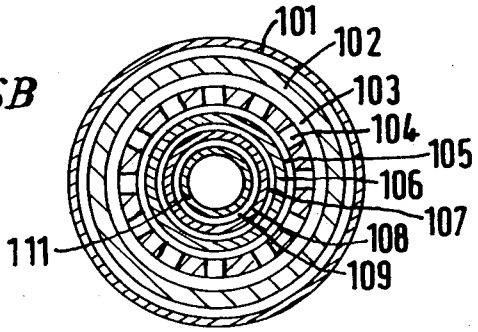

FIG. 6 represents a preferred embodiment of the invention in which the case (right part of the figure) has a structure similar to that of the foregoing figures, the introduction of hot gas occurring however through the end opening of the heating tube, while the electrical supply means of the heating tube (left part of the figure) have a structure adapted to the movements of the internal expansion of the heating tube.

The apparatus in this modification comprises an outer protective jacket 101 surrounding the case formed by the tubes 102 and 104 arranged coaxially, for example of refractory steel, between which is formed a gas circulating space 103. This space 103 has a helical shape machined in the outer surface of the tube 104, the gas being introduced through the orifice 123 in the region of the end (left side of the figure) of the case, and issuing through the opening 120 (right end in the figure) so as to flow through the passage 105 between the inner wall of the tube 104 and a first, inert, non-heating alumina tube 106, the gas thus returning to the region of the left end. It then flows through the passage 107 between the first tube 106 and a second tube 108 of the same type as tube 107. The gas thus returns to the region of the right end of the case where a passage 121 is provided for returning the gas in contact with the outer surface of the heating tube 111 in the passage 109 between the last and the second alumina tube 108. The gas then enters the interior of the heating tube 111 through the openings 110 located in a centering element 124 which also transmits the electric voltage to the heating tube 111 through the electric contact 126.

The current passes through the region of the annular flange 112. The gas travels throughout the heating tube and is discharged (at the right end of the figure) through a passage 114 on the axis of the heating tube 111 in the side wall 115. Fixed to the latter, in the embodiment of FIG. 6A, is a nozzle 116 whose passage 117 is in the extension of the passage 114, this nozzle also including a fuel supply passage 118.

This nozzle permits using the hot gas, for example oxygen, in an oxy-fuel torch or an oxy-fuel burner.

The side wall 115 is electrically connected to the heating tube through a washer 113, for example of platinum, mounted at the end of the heating tube 111, for example of lanthanum chromite.

The electric circuit is connected to the electric contact 135 is completed through the steel tubes 102 and 104 which are maintained coaxially to each other by side wall 127 on which the conductive members 128 and 136 are fixed which surrounds the electric connections.

The electric contact 126, whose end constitutes the centering element 124 of the heating tube 111, is electrically insulated from the contact case member 128 by a slidable member 125 fixed on the contact 126 and slidable inside the member 128 against which it may abut at 138 under the effect of a coil spring 131 thus enabling the heating tube 111 to be maintained in position, an expansion of the latter compressing said spring. The end (left side of the figure) of the contact 126 is connected to a flexible wire 130, for example of platinum, of sufficient length to accommodate the expansions of the apparatus, the other end of the wire being connected to the contact 133 fixed in the insulating members 132 and 139 from which extends the second electric contact 134 for connecting the heating tube to electric supply means (not shown in the figure). The member 132 has an annular recess within which is the spring 131. The member 136 which surrounds the insulating members 125, 132, 139 has a space 137 for the circulation of cooling water in the region of the electric contacts for preserving the characteristics of the spring and the sealing elements of the case. It must be noted that, in operation, the spring 131 maintains the electric contact between the heating tube 111 and the contact 126 upon both contraction and expansion.

For the heating of the oxidizing gases, a heating tube is used made from lanthane chromite, zirconia, molybdenum bisilicide or silicon carbide. When neutral or reducing gases are used also carbon, graphite, molybdenum, tungsten, tantalum or, silicon carbide may also be employed.

In a general way, and whatever the gas used, a material is used which may reach at the most a temperature on the order of 2300° C. by the Joule effect.

To increase the temperature of the gas issuing from the apparatus at a constant flow, it is desirable to place a plurality of heating tubes coaxially with a circulation of gas therebetween in the form of longitudinal baffles (as is the case between the tubes 106, 108 and 111) or by machining a helical passage on the surface of a tube which is slipped exactly or roughly inside the other (as in the case of the tubes 102 and 104).

What is claimed is:

1. An apparatus for producing a jet of gas at high temperature comprising a case, means for introducing a gas into said case, means for heating the gas in the case and means for discharging the hot gas from the case, the means for heating the gas in the case comprising an electrically conductive heating tube having a first end and a second end opposed to the first end and extending through the case, said tube constituting an electrical heating resistance, said tube having an opening near its first end, electric connecting means for the connection of an electric supply directly to a portion of said heating tube, and heat exchange means disposed inside said case and around the heating tube and in thermal contact with the heating tube, the heating means comprising at least one pipe for conducting the gas from the gas-introducing means to said opening, the second end of the heating tube communicating with the means for discharging hot gas from the case, the gas being thus heated in the heat exchange means before entering the interior of the heating tube and finally flowing through the means for discharging the hot gas from the case.

2. An apparatus according to claim 1, wherein the opening of the heating tube is defined by the first end of said tube.

3. An apparatus according to claim 1, wherein the opening of the heating tube is through a lateral wall of said tube.

4. An apparatus according to claim 1, wherein the means for discharging the hot gas from the case comprise a nozzle connected to the second end of the heating tube.

5. An apparatus according to claim 1, further comprising means for pre-heating the gas, said preheating means surrounding at least a portion of the case so that the gas is pre-heated before entering the case.

6. An apparatus according to claim 5, wherein the case is tubular and has two ends which are respectively closed by a first transverse closing side wall, and a second transverse closing side wall, and means for discharging the hot gas from the case extending through the second side wall.

7. An apparatus according to claim 6, wherein the gas pre-heating means have an inlet and an outlet, the inlet being adjacent to the first transverse closing side wall, the outlet of the gas pre-heating means communicating with the interior of the tubular case, and the heating tube is provided with at least one opening for the passage of the gas located adjacent to the second closing side wall.

8. An apparatus according to claim 6, wherein the gas pre-heating means have an inlet and an outlet, the inlet being adjacent to the second transverse closing side wall, the outlet communicating with the interior of the tubular case, and the heating tube is provided with at least one opening for the passage of the gas located adjacent to the first transverse closing side wall.

9. An apparatus according to claim 6 which further comprises an insulating sleeve located, in the central portion of the first transverse closing side wall, an electric contact element disposed within said insulating sleeve, said insulating sleeve being axially slidably mounted in the first transverse closing side wall, and spring means for biasing said insulating sleeve toward the interior of the case.

10. An apparatus according to claim 6, which further comprises an electric supply terminal located in the first transverse closing side wall, a braided cable which connects said electric supply terminal to the end of the heating tube which is adjacent to the first transverse closing side wall, and a thermocouple which is introduced inside the heating tube through the first transverse closing side wall.

11. An apparatus according to claim 6, which further comprises an electric supply terminal located in the first transverse closing side wall, a braided cable which connects said electric supply terminal to the end of the heating tube which is adjacent to the first transverse closing side wall, and another tube for the heating of a fluid introduced inside the heating tube through the first closing wall.

12. An apparatus according to claim 6, wherein the first transverse closing side wall is in thermal contact with a chamber for the flow of cooling water.

13. An apparatus according to claim 6, which further comprises a tube for the flow of cooling water which is in thermal contact with the first transverse closing side wall.

14. An apparatus according to claim 6, which further comprises a radiator in thermal contact with the first transverse closing side wall for air cooling the first transverse closing side wall.

15. An apparatus according to claim 5, wherein the gas pre-heating means comprise a coiled tube surrounding the tubular case and in thermal contact with the case.

16. An apparatus according to claim 5, wherein the gas pre-heating means has a cylindrical chamber surrounding the heat exchanger.

17. An apparatus according to claim 5, wherein the gas pre-heating means has a screwthread machined in the outer surface of the tubular case.

18. An apparatus according to claim 5, comprising a centering element for maintaining the heating tube in position and defining openings for introducing the gas of the pre-heating means into the heating tube through one of the ends thereof.

19. An apparatus according to claim 18, which further comprises an electric contact element which is movable in translation so as to accommodate the longitudinal expansions of the heating tube and which is in the vicinity of the centering element.

20. An apparatus according to claim 19, comprising a case member, a fixed electric contact element mounted on the case member but electrically insulated therefrom, and a flexible wire connecting the fixed electric contact element to the movable electric contact element.

21. An apparatus according to claim 1, wherein the heating tube is made from a material which, under the Joule effect, may reach a temperature on the order of 2300° C.

22. An apparatus according to claim 1, wherein the heating tube is made from a material selected from one or more materials comprising zirconia, lanthanum chromite, silicon carbide, molybdenum disilicide, carbon, graphite, molybdenum, tungsten and tantalum.

23. An apparatus according to claim 1, wherein the heating tube has a resistant central portion capable of being heated under the Joule effect and at least one end portion made from a material of low electrical resistivity.

24. An apparatus according to claim 1, wherein the heat exchanging means comprise at least one inner tube made from a dense thermoconductive material and an outer tube made from a porous thermoconductive material and surrounding the inner tube.

25. An apparatus according to claim 10, comprising a winding of zirconia felt between the outer tube and the case.

26. An apparatus according to claim 24, wherein at least one of the tubes comprising the heat exchange means has longitudinal grooves for the passage of the gas in the heat exchange means.

27. An apparatus according to claim 24, wherein at least one of the tubes comprising the heat exchange means has a screwthread on the surface thereof, said screwthread forming a helical space for the passage of the gas in said heat exchange means.

28. An apparatus according to claim 1, wherein a thermoconductive tube is axially disposed in the heating tube.

29. An apparatus according to claim 28, wherein the thermoconductive tube extends through the major part of the length of the heating tube to the vicinity of its end portion and the tube is provided in said end portion with at least one opening for the passage of the gas toward the means for discharging the hot gas from the case.

* * * * *